US005950913A

United States Patent [19]

Rea et al.

[11] Patent Number: 5,950,913

[45] Date of Patent: Sep. 14, 1999

[54] COMPOSITE DOUGH CONTAINER WITH MULTIPLE STACKED INGREDIENT CUPS

[75] Inventors: Keith R. Rea, Florence, S.C.; Keith E. Antal, Valatia, N.Y.

[73] Assignee: Sonoco Development, Inc., Hartsville, S.C.

[21] Appl. No.: 09/118,545

[22] Filed: Jul. 17, 1998

[51] Int. Cl.[6] ..... B65D 25/04

[52] U.S. Cl. ..... 229/120.32; 220/4.26; 220/23.88; 426/128; 206/830; 206/499; 229/4.5

[58] Field of Search ..... 220/23.83, 23.88, 220/23.86, 4.26; 426/120, 128; 206/216, 830, 499; 229/120.32, 14.5

[56] References Cited

U.S. PATENT DOCUMENTS

| | | | |
|---|---|---|---|
| 1,608,159 | 11/1926 | Bergmann | 206/499 |
| 1,904,741 | 4/1933 | Lorber | 206/499 X |
| 2,236,641 | 4/1941 | Karmen . | |
| 2,604,976 | 7/1952 | Sarg | 206/499 X |
| 2,663,450 | 12/1953 | Broucart | 220/23.86 |
| 2,949,369 | 8/1960 | Zoeller et al. | 426/128 X |
| 3,182,890 | 5/1965 | Elam . | |
| 3,243,038 | 3/1966 | Caramanian . | |
| 3,506,459 | 4/1970 | Parlour . | |
| 3,851,757 | 12/1974 | Turpin . | |
| 4,114,784 | 9/1978 | Hough et al. . | |
| 4,119,231 | 10/1978 | Johnson | 206/499 X |
| 4,627,986 | 12/1986 | Bardsley et al. | 426/112 |
| 5,279,841 | 1/1994 | Yu | 426/120 X |
| 5,335,809 | 8/1994 | Toida et al. | 220/23.86 |
| 5,388,698 | 2/1995 | Wakao | 206/499 X |
| 5,447,236 | 9/1995 | Perry et al. | 426/128 X |
| 5,535,908 | 7/1996 | Sheu | 220/4.26 |
| 5,617,679 | 4/1997 | Meyers | 220/4.26 X |
| 5,852,901 | 12/1998 | Meyers | 220/4.26 X |

*Primary Examiner*—Gary E. Elkins
*Assistant Examiner*—Tri M. Mai
*Attorney, Agent, or Firm*—Alston&Bird LLP

[57] ABSTRACT

A composite container for dough or other expandable product includes a hollow cylindrical body formed of composite material, a pair of end closures for sealing the open end of the container body, a separator disk disposed in the body and dividing the container into a first tubular portion for containing the product and a second tubular portion. A plurality of ingredient cups are stacked bottom-against-top in the second portion of the container body. Each cup is a cup-shaped member having a cylindrical tubular side wall, a bottom wall closing one end of the side wall, and an open end defined by an upper edge of the side wall. A membrane engages the upper edge to sealingly close the cup with an additional ingredient such as condiment, icing, spices, etc., therein. The bottom of one cup stacks on the upper edge of another cup so that the one cup is not supported by the membrane of the other cup. The separator disk engages an annular flange on the upper edge of the adjacent cup. Axial forces exerted on the separator disk by expanding product are transmitted to the side wall of the adjacent cup, which transmits the forces to the side wall of the next cup, and so on, the forces ultimately being transmitted to the end closure.

10 Claims, 1 Drawing Sheet

COMPOSITE DOUGH CONTAINER WITH MULTIPLE STACKED INGREDIENT CUPS

FIELD OF THE INVENTION

The present invention relates to composite containers for packaging an expandable product such as dough along with additional ingredients such as condiments, icing, spices, or the like.

BACKGROUND OF THE INVENTION

In the packaging of some refrigerated dough products in containers including spirally wound composite containers having double seamed metal ends, it is sometimes desirable to include additional ingredients such as condiments, icing, spices, and the like, inside the container so that when the consumer opens the container to remove the refrigerated dough for baking, they will also have access to the additional ingredients. It has been common practice to package icing in a pouch, place the icing in a paper sleeve and position the paper sleeve at one end of the refrigerated dough container and to have a loose metal separator between the dough and the icing pouch positioned in the paper sleeve. However, this arrangement produced major problems in that the refrigerated dough in the container often exudes a "syrup"-like substance which can pass by the metal separator and penetrate the paper sleeve containing the icing pouch resulting in disintegration and crushing of the sleeve and ultimately in container failure. The edge of the metal separator often also cuts into the container liner allowing the dough "syrup" to wet the body of the container and subsequently leading to reduced shelf life of the refrigerated dough package.

In order to overcome some of these problems, it has been suggested to utilize a small cup of plastic or like material to be positioned at one end of the refrigerated dough container with the open end facing the end closure for containing the additional ingredient within the cup. This type of arrangement is disclosed in prior U.S. Pat. No. 3,182,890. However, the U.S. Pat. No. '890 does not disclose a container capable of containing more than one additional ingredient and keeping the ingredients separate from the dough and from each other.

SUMMARY OF THE INVENTION

The present invention provides a composite container for an expandable product such as refrigerated dough, which includes provisions for containing two or more additional ingredients in separate ingredient cups that are configured to resist deformation under the pressure loads exerted on the cups from expanding dough or other product, such that the cups remain sealed and the additional ingredients are thereby kept separate from the dough and from each other.

To these ends, the invention provides a composite container comprising a tubular composite container body having first and second open ends, with first and second generally disk-shaped end closures adapted to sealingly close the first and second open ends, respectively. The container includes at least two ingredient cups each including a generally tubular side wall having an upper edge defining an open end with the other end closed by a bottom wall and a removable membrane which engages the upper edge for closing the open end of the cup to seal an ingredient therein. The cups are adapted to be stacked within the container body with the bottom wall of a first of the cups resting on the first end closure and a second cup stacked with the bottom wall thereof supported by the upper edge of the first cup such that axial force imparted on the second cup toward the first cup is transmitted to the side wall of the first cup. The container also includes a generally rigid separator disk for separating dough in the container from the cups, the separator disk being configured to engage the upper edge of the second cup for transmitting axial force thereto. Thus, pressure from dough in the container is exerted on the separator disk and is transmitted from the separator disk through the side walls of the cups to the first end closure such that the cups are not substantially deformed.

Preferably, the container body is generally cylindrical and the upper edge of each cup is defined by a radially outwardly extending generally annular flange having an outer edge slightly smaller in diameter than the inner diameter of the container body such that the cups closely fit therein. The separator disk preferably includes a generally planar center portion having a circular outer periphery and a cylindrical ring joined to the outer periphery, the cylindrical ring being configured to engage the annular flange of the second cup for transmitting axial force thereto. Advantageously, the opposite sides of the separator disk are identical to each other such that the separator disk may be placed in the container body with either of the sides facing the stacked ingredient cups.

In accordance with a preferred embodiment of the invention, each cup includes a raised rim upstanding from the outer edge of the annular flange and defining an uppermost surface of the cup, and each cup is closed by the membrane engaging the annular flange radially inward of the raised rim, whereby the membrane is recessed below the uppermost surface of the cup. The engagement between the separator disk and the adjacent cup occurs at the raised rim, and therefore the membrane is protected against being pushed in by pressure from the dough in the container.

The side wall of each cup preferably includes longitudinally extending ribs for structurally reinforcing the side wall. The ribs advantageously are circumferentially spaced around the side wall so that the axial load-bearing strength of the cup is generally uniform about the circumference.

BRIEF DESCRIPTION OF THE DRAWINGS

The above and other objects, features, and advantages of the present invention will become apparent from the following detailed description of a preferred embodiment of the invention, when taken in conjunction with the accompanying drawings, in which.

DETAILED DESCRIPTION OF THE PREFERRED EMBODIMENT

Figure 1:
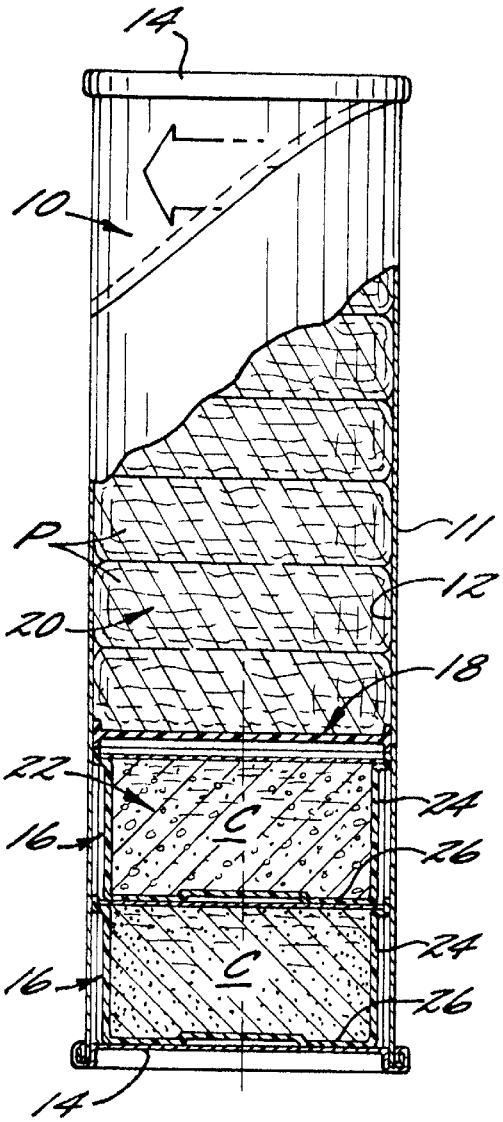
FIG. 1 is an elevational view, partially broken away and in section, of a container having refrigerated dough or other expandable products therein and multiple stacked ingredient cups therein, which is constructed in accordance with the present invention.

Referring now to FIG. 1 of the drawings, there is shown a container 10 for refrigerated dough or other expandable products P in accordance with a preferred embodiment of the invention. The container 10 comprises an elongate generally cylindrical body 11 having an interior wall 12 of a predetermined diameter. The container 10 further includes end closures 14. A preferred construction of the body 11 of the container 10 when used for refrigerated dough products P is a spirally-wound construction of composite material, typically including an inner liner layer of plastic and/or foil, multiple layers of thin paperboard, and an outer paper label layer. These spirally-wound composite containers are well understood by those with ordinary skill in the art and a full explanation hereof is not deemed necessary for an understanding of this invention. The end closures 14 are preferably metal ends seamed to the body portion 11, as shown in FIG. 1 and which is also well known to those with ordinary skill in the art.

The container 10 also includes at least two cups 16 for additional ingredients such as condiments, icing, spices, etc., and a separator disk 18 which separates the container into a first tubular portion 20 for containing dough or other expandable product P and a second tubular portion 22 for containing the cups 16. The separator disk 18 is axially movable within the container 10, and comprises a solid generally disk-shaped member whose outer diameter is slightly smaller than the diameter of the inner wall 12 of the container body 11 such that the separator disk 18 produces a firm friction fit with the inner wall 12.

Figure 2:
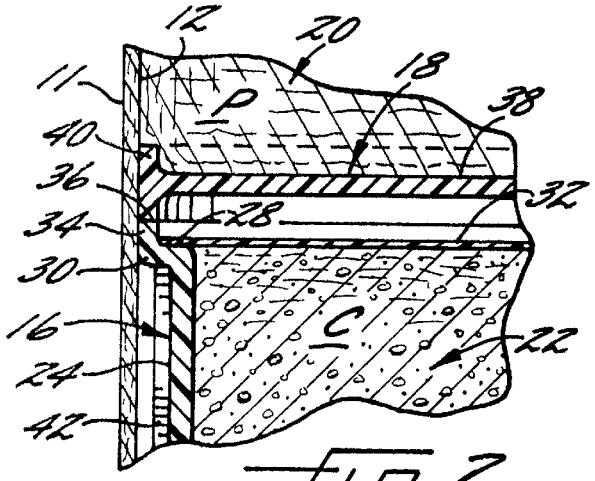
FIG. 2 is a somewhat enlarged fragmentary sectioned side view of the container of FIG. 1, showing the separator disk engaging the upper edge of the innermost cup in greater detail.
Figure 3:
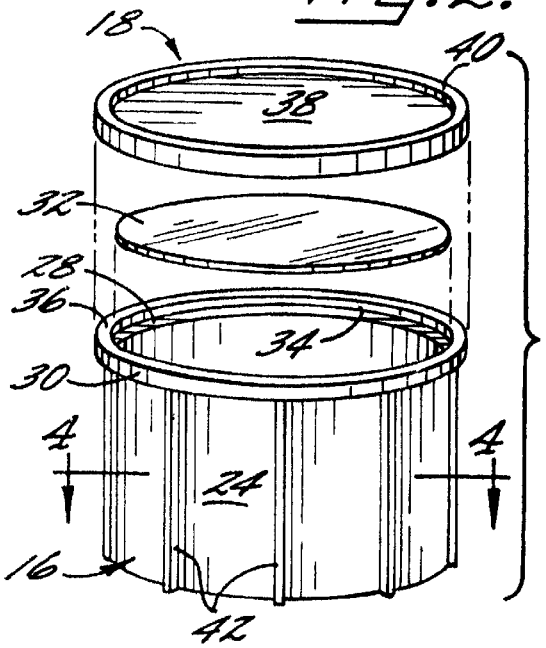
FIG. 3 is an exploded perspective view of the ingredient cup and separator disk in accordance with the invention.
Figure 4:
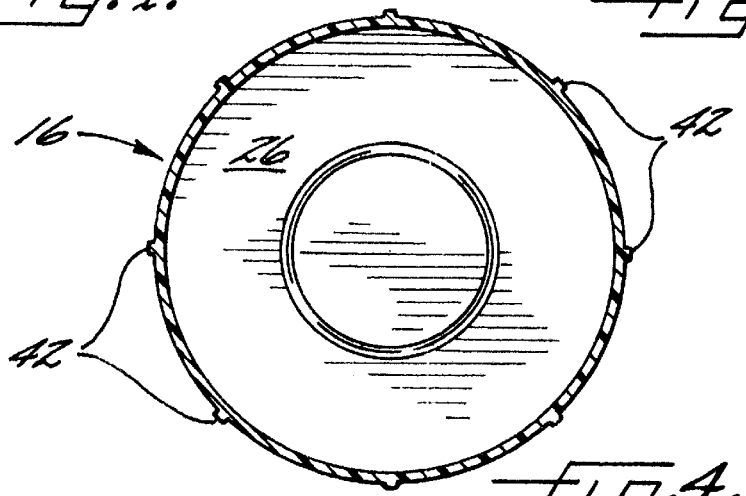
FIG. 4 is a cross-sectional view of one of the ingredient cups taken on line 4—4 of FIG. 3.

With primary reference to FIGS. 2–4, each of the cups 16 comprises a cup-shaped member defined by a tubular side wall 24 having one end closed by a bottom wall 26 and the other end open. The open end is defined by the upper edge 28 of the side wall 24. A radially outwardly extending generally annular flange 30 is connected to the upper edge 28 of the cup. A removable membrane 32 sealingly engages the upper edge 28 and the annular flange 30 for sealing the contents C in the cup.

The annular flange 30 and the separator disk 18 are configured to cooperate so that axial pressure exerted on the separator disk 18 by expanding dough or other product P is transmitted to the flange 30 and thence to the side wall 24 of the adjacent cup without disturbing the membrane 32. To these ends, the flange 30 includes a raised rim 34 which upstands from the outer periphery of the flange. The top surface of the rim 34 defines the uppermost surface 36 of the cup 16. The separator disk 18 includes a generally planar center portion 38 having a circular outer periphery, and a cylindrical ring 40 connected to the outer periphery of the center portion 38. The cylindrical ring 40 engages the uppermost surface 36 of the raised rim 34 such that the center portion 38 of the separator disk is axially spaced from the membrane 32, which engages the flange 30 inward of the raised rim 34 and therefore is recessed below the uppermost surface 36. Thus, axial pressure exerted by the product P on the separator disk 18 is transmitted from the cylindrical ring 40 to the raised rim 34, and through the annular flange 30 to the side wall 24 of the innermost cup 16.

The separator disk 18 advantageously is configured such that its opposite sides are identical to each other, i.e., the disk is symmetric about a plane parallel to the planar center portion 38. Accordingly, the separator disk 18 may be placed in the container with either of the sides facing the cups 16.

The cups 16 are configured to stack bottom-against-top so that axial load is transmitted through the side walls and so that the cups are not substantially deformed by the pressure load from the expanding product P. Thus, the side wall 24 is cylindrical such that the outer edge portion of the bottom wall 26 where it joins with the lower edge of the side wall will rest atop the upper edge 28 of another of the cups. Accordingly, axial force is transmitted down the stack of cups 16 via the side walls 24 to the end closure 14. By virtue of their cylindrical construction, the side walls 24 carry the axial forces without substantially deforming. Moreover, the membranes 32 are not load-bearing members, and therefore the sealed connections of the membranes to the cups are not disturbed by the pressure of the expanding product.

The side wall 24 of each cup preferably includes longitudinally extending ribs 42 which are circumferentially spaced about the side wall and extend generally radially outward from the outer surface of the side wall. The ribs 42 act as axial load-bearing columns for imparting further axial loading-bearing strength to the cups. Preferably, the radially outermost surfaces of the ribs adjacent the bottom wall 26 define an outer diameter that is slightly smaller than the inner diameter of the raised rim 34 so that the bottom end of one cup will nest in the top end of another cup resting on the upper edge 28 and flange 30 as previously described. Further, the ribs 42 preferably have a constant radial thickness over their length.

In accordance with the invention, a stack of ingredient cups 16 having condiments, icing, spices, or the like sealed therein by membranes 32 are inserted upper-edge-first into one end of a container body 11 either individually and sequentially, or as a stacked unit. An end closure 14 (the lower end closure in FIG. 1) is crimped onto the end of the can adjacent the bottom wall 26 of the lower or outermost cup. The separator disk 18 is inserted into the container body 11, either before or after the cups are inserted. Once the separator disk 18 and the cups 16 are in place in the container and the lower end closure 14 is attached, a quantity of dough or other expandable product P is placed into the container above the separator disk, and the other end closure 14 is crimped onto the other end of the container body 11.

During subsequent storage and shipment, the product P may expand and thereby exert axial pressure on the separator disk 18. The separator disk 18 transmits the resulting axial forces to the side wall 24 of the adjacent cup 16, which in turn transmits the axial forces to the side wall of the next cup, and so on, until the forces are ultimately transmitted to the lower end closure 14. Thus, substantially no load is carried by the closure membranes 32 of the cups, so that the sealed conditions of the cups are not compromised.

In the drawings and the specification, there has been set forth a preferred embodiment of the invention and, although specific terms are employed, the terms are used in a generic and descriptive sense only and not for purpose of limitation, the scope of the invention being set forth in the following claims.

What is claimed is:

1. A composite container for dough with multiple stacked cups for containing additional ingredients, and comprising:

a tubular composite container body having first and second open ends;

first and second end closures adapted to sealingly close the first and second open ends, respectively, of the container body;

at least first and second ingredient cups each including a generally tubular side wall having a first upper edge defining an open end and further including a bottom wall which closes the other end of the cup, and a removable membrane which engages a second upper edge for closing the open end of the cup, the cups being adapted to be stacked within the container body with the bottom wall of the first cup resting on the first end closure and the second cup stacked with the bottom wall thereof supported by the first upper edge of the first cup such that axial force imparted on the second cup toward the first cup is transmitted to the side wall of the first cup; and a generally rigid separator disk for separating dough in the container from the cups, the separator disk being configured to engage the first upper edge of the second cup for transmitting axial force thereto;

whereby pressure from dough in the container is exerted on the separator disk and is transmitted from the separator disk through the side walls of the cups to the first end closure such that the cups are not substantially deformed.

2. The composite container of claim 1, wherein the container body is generally cylindrical having inner and outer diameters, and the upper edge of each cup is defined by a radially outwardly extending generally annular flange having an outer edge slightly smaller in diameter than the inner diameter of the container body such that the cups closely fit therein.

3. The composite container of claim 2, wherein the side wall of each cup includes longitudinally extending ribs for structurally reinforcing the side wall.

4. The composite container of claim 2, wherein the separator disk includes a generally planar center portion having a circular outer periphery and a cylindrical ring joined to the outer periphery, the cylindrical ring being configured to engage the annular flange of the second cup for transmitting axial force thereto.

5. The composite container of claim 2, wherein the separator disk includes opposite sides which are substantially identical to each other such that the separator disk may be placed in the container body with either of the sides facing the stacked ingredient cups.

6. The composite container of claim 2, wherein each cup includes a raised rim upstanding from the outer edge of the annular flange and defining an uppermost surface of the cup, and wherein each cup is closed by the membrane engaging the annular flange radially inward of the raised rim, whereby the membrane is recessed below an uppermost surface of the cup.

7. The composite container of claim 6, wherein the separator disk is configured to engage the uppermost surface on the raised rim of the second cup such that the membrane of the second cup is not contacted by the separator disk.

8. A composite container filled with an expandable product and additional ingredients, and comprising:

a tubular composite container body having first and second open ends;

a generally rigid separator disk coaxially positioned in the container body so as to divide the container body into a first tubular portion accessible through the first open end and a second tubular portion accessible through the second open end;

an expandable product substantially filling the first portion of the container body;

a first end closure sealingly closing the first open end of the container body;

a plurality of ingredient cups each including a generally tubular side wall having an upper edge defining an open end of the cup and further including a bottom wall which closes the other end of the cup and a membrane for removably engaging the upper edge to close the open end of the cup, the cups being configured to be stackable with the bottom wall of one cup being supported on the upper edge of another cup, each cup being filled with an additional ingredient and being closed by the removable membrane, one of the cups being inserted into the second portion of the container body until the upper edge of the cup engages the separator disk and each of the other cups being inserted upper-edge-first into the container body until the upper edge engages the bottom wall of a previously inserted cup; and a second end closure sealingly closing the second open end of the container body and engaging the bottom wall of the last-inserted cup;

whereby pressure generated by expansion of the product in the container is exerted on the separator disk and is transmitted axially from the separator disk through the side walls of the cups to the second end closure such that the cups are not substantially deformed.

9. The composite container of claim 8, wherein the side wall of each cup is generally cylindrical and includes a plurality of circumferentially spaced ribs which extend longitudinally along the outer surface of the side wall for structurally reinforcing the cup.

10. The composite container of claim 9, wherein the upper edge of the side wall of each cup includes a generally annular flange extending radially outward of the side wall, the flange including a raised rim upstanding therefrom, and wherein the separator disk is configured to engage the raised rim for transmitting axial load to the cup.

* * * * *